US005271323A

United States Patent [19]

Münker

[11] Patent Number: 5,271,323

[45] Date of Patent: Dec. 21, 1993

[54] SHEET REVERSING ASSEMBLY FOR ROTARY PRESS

[75] Inventor: Jürgen F. F. Münker, Unterpleichfeld, Fed. Rep. of Germany

[73] Assignee: Koenig & Bauer Aktiengesellschaft, Wurzburg, Fed. Rep. of Germany

[21] Appl. No.: 37,590

[22] Filed: Mar. 26, 1993

[30] Foreign Application Priority Data

Mar. 30, 1992 [DE] Fed. Rep. of Germany ..... 4210327

[51] Int. Cl.[5] ..... B41F 1/30

[52] U.S. Cl. ..... 101/409; 101/142; 271/82; 271/309

[58] Field of Search ..... 101/142, 409, 415.1; 271/82, 309, 11

[56] References Cited

U.S. PATENT DOCUMENTS

| | | | |
|---|---|---|---|
| 3,768,406 | 10/1973 | Gutsche et al. | 101/409 |
| 3,986,455 | 10/1976 | Jeschke et al. | 101/409 |
| 4,127,265 | 11/1978 | Wirz et al. | 271/82 |
| 4,241,659 | 12/1980 | Fischer | 271/82 |
| 4,358,100 | 11/1982 | Müller | 271/11 |
| 4,395,949 | 8/1983 | Jeschke . | |
| 4,718,342 | 1/1988 | Raab et al. | 101/409 |
| 4,864,929 | 9/1989 | Simeth | 101/409 |
| 5,186,107 | 2/1993 | Wieland | 271/82 |

FOREIGN PATENT DOCUMENTS

| | | |
|---|---|---|
| 2354418 | 10/1973 | Fed. Rep. of Germany . |
| 2358839 | 11/1973 | Fed. Rep. of Germany . |
| 2914362 | 4/1979 | Fed. Rep. of Germany . |

*Primary Examiner*—Eugene H. Eickholt

*Attorney, Agent, or Firm*—Jones, Tullar & Cooper

[57] ABSTRACT

A sheet reversing assembly for a rotary printing press utilizes one or more arcuately and radially movable gripper assemblies on an impression cylinder to elevate a gripped leading edge of a sheet to be reversed. As the trailing edge of the sheet is engaged by suction grippers on a reversing drum, air blast jets in the vicinity of the abutment surface of the gripper assembly direct air under pressure between the sheet and the surface of the impression cylinder.

6 Claims, 3 Drawing Sheets

SHEET REVERSING ASSEMBLY FOR ROTARY PRESS

FIELD OF THE INVENTION

The present invention is directed generally to a sheet reversing assembly for a rotary press. More particularly, the present invention is directed to a sheet reversing assembly in which a sheet to be reversed is released to an intermediate sheet transfer drum. Most specifically, the present invention is directed to a sheet reversing assembly that utilizes a gripper bar assembly which facilitates the release of the sheet from the impression cylinder. The sheet to be reversed is secured at its leading edge to sheet grippers and a gripper bar on an impression cylinder in the rotary printing press. When the trailing edge of the sheet is engaged by suction grippers on the transfer drum, the gripper bar on the impression cylinder elevates the now trailing edge of the sheet being reversed and directs an air blast between the sheet and the periphery of the impression cylinder. The transferring sheet is thereby released from the surface of the impression cylinder.

DESCRIPTION OF THE PRIOR ART

In various printing processes and specifically in such processes where a sheet being printed in a rotary printing press is to be printed on both sides using first and second impression cylinders, it is necessary to turn over or reverse the sheet. This allows the first side of the sheet which was printed while the sheet was supported on the first impression cylinder to be placed against the surface of the second impression cylinder. The previously unprinted second side of the sheet is now able to be printed while it is supported by the second impression cylinder.

In the typical prior art sheet reversing assembly, the trailing edge of the sheet is removed from the first impression cylinder by vacuum sheet grippers on the transfer cylinder and is then transferred to an assembly of sheet grippers and a cooperating gripper on the sheet transfer cylinder. Since this sheet has just completed being printed on a first side while being supported on the first impression cylinder and has thus been pressed against the surface of the first impression cylinder, there is no longer a continuous air cushion between the sheet and the impression cylinder. This lack of air cushion has for a consequence that, during the sheet reversing process the sheet is not easily released from the surface of the first impression cylinder and the vacuum grippers on the sheet transfer cylinder are not able to move the sheet in sheet reversal direction.

Various countermeasures have been undertaken in the prior art to facilitate the removal of the sheet from the surface of the first impression cylinder so that it can be properly handled and reversed by the transfer cylinder and delivered to the second impression cylinder in a reversed orientation. One such countermeasure has been to provide the surface of the impression cylinder with a somewhat roughened surface. This will lessen the forces required to remove the printed sheet from the surface of the impression cylinder. However, the use of such rough surfaces reduce the print quality, especially when the paper being printed is quite thin. Another somewhat similar procedure is to clamp screen onto the printing surfaces of the impression cylinders. This is a very costly procedure and again reduces the print quality.

In the German published unexamined patent application No. 23 58 839 there is shown a prior art sheet releasing register that is used on a reversing drum of sheet-fed rotary printing presses which operate according to the principle of taking over the rear edges of sheets for an alternative recto/verso printing of previous cylinders. In this prior art device, the gripper system, which is holding the sheet in the direction of rotation of the cylinder, is moved by a tipping device on the periphery of the cylinder. Air is blown against the front edge of the sheet. One limitation of this prior art sheet releasing system is that since the holding powers on the periphery of the cylinder are so big that they hold the sheet on the peripheral surface of the cylinder. Also, since the air escape openings which are arranged near the gripper abutment area blow air at the sheet in a lateral direction, the escaping air blast does not influence the entire length of the sheet and thus does not fan it completely. It is another limitation of this prior art device that the releasing procedure of the sheet on the peripheral surface of the cylinder is completed before the rear edge of the sheet can be taken over by the vacuum grippers of the transfer cylinder. This makes an exact sheet register impossible to guarantee.

It will thus be seen that a need exists for a sheet reversing assembly which overcomes the limitations of the prior art. The sheet reversing assembly for a rotary printing press in accordance with the present invention provides such a device and is a significant improvement over the prior art devices.

SUMMARY OF THE INVENTION

It is an object of the present invention to provide a sheet reversing assembly for a rotary press.

Another object of the present invention is to provide a sheet reversing assembly utilizing a sheet transfer drum.

A further object of the present invention is to provide a sheet reversing assembly which utilizes a sheet gripper bar that pivots with respect to the surface of the impression cylinder.

Yet another object of the present invention is to provide a sheet reversing assembly which fans the printed sheet to be transported on the peripheral surface of the impression cylinder.

Still a further object of the present invention is to provide a sheet reversing assembly which transfers the sheet in a register true orientation to the reversing drum.

As will be discussed in greater detail in the description of the preferred embodiment, which is set forth subsequently, the sheet reversing assembly for a rotary printing press in accordance with the present invention utilizes sheet gripper assemblies which are pivotably positioned on the surface of the impression cylinder and which are pivotable to elevate the gripper abutment surface of each gripper assembly radially outwardly from the surface of the impression cylinder. A plurality of air blast nozzles are positioned along each gripper abutment surface and are usable to discharge air under pressure between the peripheral surface of the impression cylinder and the inner surface of the sheet being printed. An air blast device is also positionable between the first impression cylinder and a cooperating sheet transfer cylinder. The sheet reversing assembly of the present invention is able to overcome the limitations of the prior art devices and can accomplish sheet reversal in an effective manner.

Since the sheet gripper assembly on the first impression cylinder of the present invention can be pivotably moved radially outwardly above the circumference of the impression cylinder, the sheet of paper to be reversed is physically lifted at its leading edge away from the periphery of the impression cylinder. This lifting of the leading edge of the sheet, together with the directing of the air jets from the gripper abutment surface generally tangentially to the surface of the impression cylinder facilitates the complete fanning of the sheet on the surface of the impression cylinder. In addition, in the present invention, the vacuum sheet grippers grasp the trailing edge of the sheet on the impression cylinder while the sheet grippers on the impression cylinder are still active to facilitate a register-true transfer of the sheet onto the reversing drum.

By accurately directing and controlling the air blast for fanning the sheet, the sheet will "swim" or float on the impression cylinder so that the freshly printed outer side of the sheet to be reversed will not smear. The sheet reversing assembly of the present invention, since it also is provided with an additional air blast device between the impression cylinder and the sheet reversing drum, can be used during complicated sheet reversing procedures, such as with thin or sensitive papers. Thus a safe sheet release and reversal is guaranteed with a high register accuracy.

The sheet reversing assembly of the present invention overcomes the limitations of the prior art devices. It provides a device that is a substantial advance in the art.

BRIEF DESCRIPTION OF THE DRAWINGS

While the novel features of the sheet reversing assembly for a rotary printing press in accordance with the present invention are set forth with particularity in the appended claims, a full and complete understanding of the invention may be had by referring to the detailed description of the preferred embodiment which is presented subsequently, and as illustrated in the accompanying drawings, in which:

DESCRIPTION OF THE PREFERRED EMBODIMENT

Figure 1:
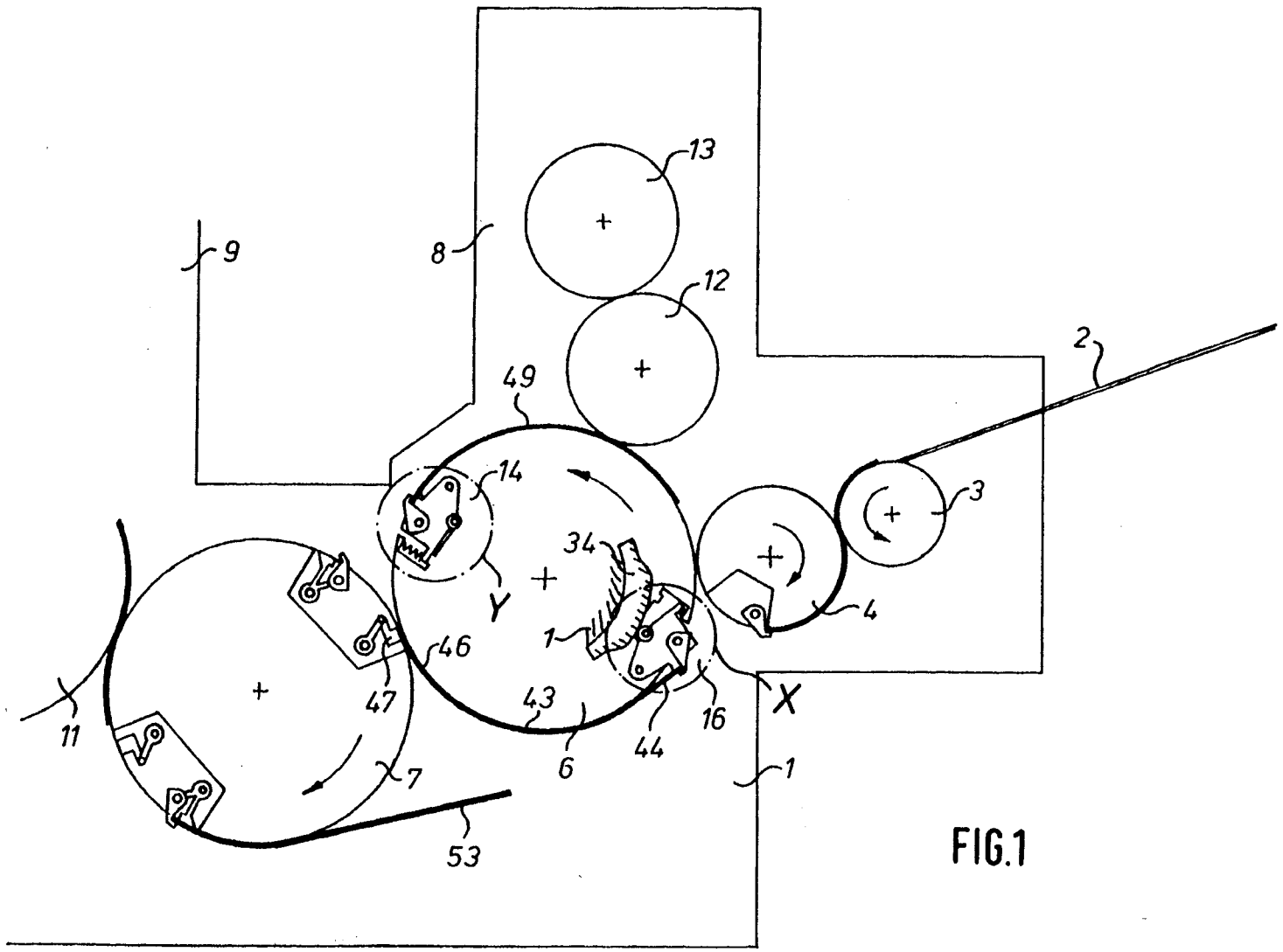
FIG. 1 is a schematic side elevation view of a portion of a multiple-color, sheet-fed rotary press including a reversing drum in reversing operation in accordance with the present invention.

Referring initially to FIG. 1, there may be seen a partial side elevation view of a multiple-color sheet fed rotary printing press which is supported generally in a machine frame which is indicated at 1. It will be understood that the multiple-color printing press shown in FIG. 1 is depicted in a schematic manner and does not show various ancillary equipment which is typically present in such devices but which has not been shown here for reasons of clarity.

The multiple-color sheet-fed rotary printing press shown in FIG. 1, receives sheets to be printed by way of a feed board 2 that terminates at a stop drum 3. The sheets are fed from the stop drum 3 to an intermediate drum 4 and then to a first impression cylinder 6. This first impression cylinder 6 is a part of a first printing unit 8 and also includes a plate cylinder 12 and a blanket cylinder 13. The sheets are printed in a first color on the first impression cylinder 6 and are then taken over by a reversing drum 7 which reverses the sheets and transfers them to a second impression cylinder 11 of a second printing unit 9. Once on the second impression cylinder the now reversed sheets can be printed by the second printing unit 9.

The first impression cylinder 6 of the first printing unit 8 is depicted as having first and second gripper systems 14 and 16. It will be understood that these two gripper systems 14 and 16 are the same in structure and operation. It will also be understood that impression cylinder 6 could be provided with more or fewer gripper systems. Each of these gripper systems 14 and 16 are shown in greater detail in FIGS. 5 and 4 respectively. For ease of illustration, these two gripper systems 14 and 16 are each shown in a generally horizontal orientation.

Figure 4:
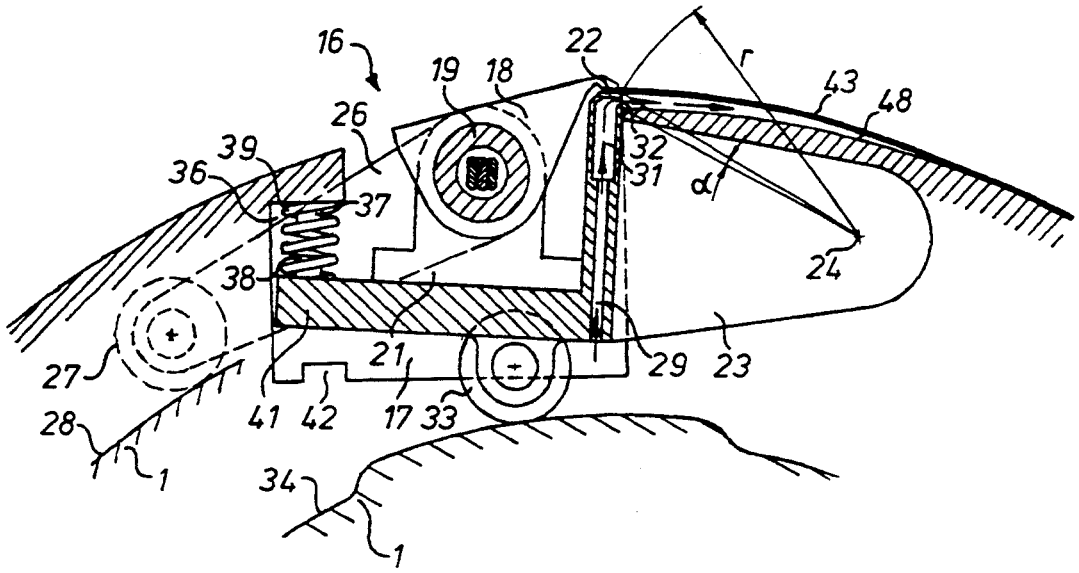
FIG. 4 is a detail view of the portion of FIG. 1 encircled at X.

Turning now to FIG. 4 there is shown one of the sheet gripper systems in accordance with the present invention at 16 in its pivoted position as it would be during the release of a sheet 43 from the peripheral surface or jacket 48 of the first impression cylinder 6. The position of the gripper 16 in FIG. 4 is to be compared with the position of the gripper assembly 14 shown in FIG. 5 which is in the rest position. Since both of these gripper assemblies 14 and 16 are the same in structure and operation, only the gripper assembly 16, shown in its pivoted, sheet release position, will be discussed in detail hereinafter. These gripper systems include an elongated gripper bar 17 which is supported in an axially extending cylinder groove 36 and which extends axially the length of the impression cylinder 6. This gripper bar 17 supports a rotatable gripper shaft 19 which is supported for rotation in spaced bearing brackets 21 that are secured to the gripper bar 17. A plurality of sheet grippers 18 are provided on the gripper shaft. These sheet grippers 18 cooperate with an axially extending gripper abutment surface member 22 to grasp and to releasably hold the leading edge portion 44 of a sheet 43 that is brought to the impression cylinder 6 by the intermediate drum 4.

Figure 5:
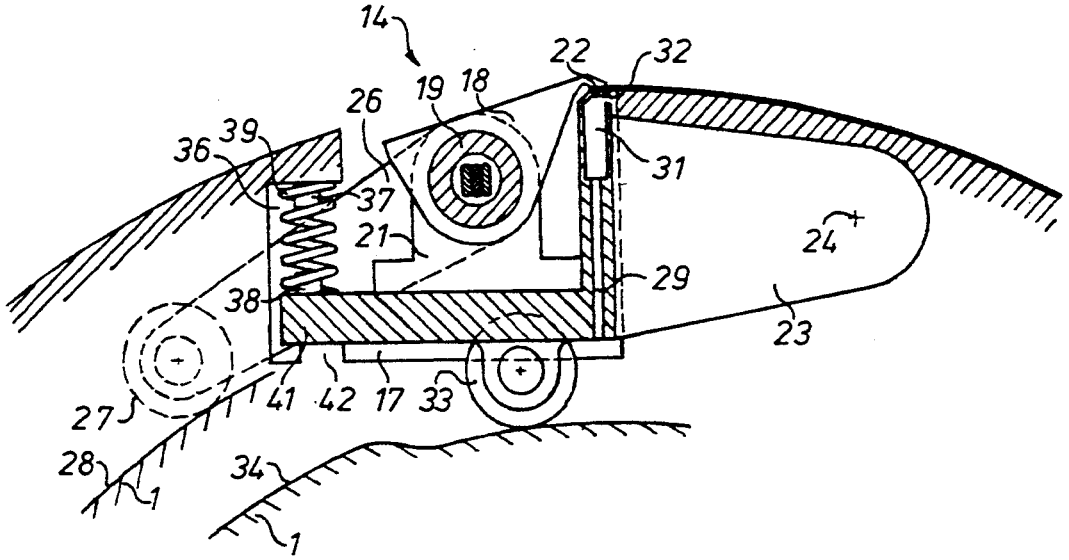
FIG. 5 is a detail view of the portion of FIG. 1 encircled at Y.

As may be seen in FIGS. 4 and 5, the gripper abutment surface member 22 is formed integrally with the gripper bar 17 and is located at a first side thereof. The gripper bar 17 and the gripper abutment surface member 22 are connected to a support arm 23 which has a fulcrum or pivot point 24. The gripper abutment surface member 22 is provided with an air supply at 29 which extends radially outwardly and terminates in an air supply duct 31 that extends in the axial direction of the gripper abutment surface member 22. A plurality of air escape openings 32, which may be air blast jets of a generally known type, are spaced axially along the gripper abutment surface member 22 directly beneath the abutment surface which is engaged by the grippers 18. As may be seen most clearly in FIG. 4 the plurality of air escape openings or air blast jets 32 are arranged in the abutment surface member 22 so that when the abutment surface member 22 is in the elevated position as depicted in FIG. 4, the air blast jets 32 are directed generally tangentially with respect to the adjacent peripheral surface or jacket 48 of the impression cylinder 6.

Again referring primarily to FIGS. 4 and 5, the gripper shaft 19 is caused to rotate or pivot in its spaced bearing brackets 21 by movement of a lever arm or roller lever 26 which is secured to the gripper shaft 19 at a first end and which carries a cam roller 27 at a second end. The cam roller 27 in turn runs on a control cam 28 which is secured to the machine frame Thus as the impression cylinder 6 rotates, the sheet grippers open and close with respect to the upper abutment surface of the abutment surface member 22.

The gripper bar 17 and its supported gripper shaft 19 and abutment surface member 22 also move radially outwardly and inwardly in cylinder groove 36, as may be seen by a comparison of FIGS. 4 and 5. This movement is in an arcuate path about the fulcrum 24 of the support arm 23 and is through a pivoting angle $\alpha$ of generally 1° to 5°, as is shown in FIG. 4. This movement of the gripper assemblies 14 and 16 is accomplished by supporting one or more cam rollers 33, which ride on one or more frame fixed control cams 34, beneath the gripper bar 17. The radially outer movement of the gripper bar 17 is opposed by one or more compression springs 39 which are mounted between a second end 41 of the gripper bar 17 and an upper lateral edge the cylinder groove 36. Suitable retaining pins 37 and 38 are placed on the cylinder groove wall 36 and the second end 41 of the gripper bar 17, respectively to restrain the compression spring 39 in place. The second end 41 of the gripper bar 17 is biased radially inwardly in the cylinder groove 36 against a cooperatively positioned stop 42 by the spring force of the compression spring 39.

The operation of the sheet reversing assembly for a rotary printing press in accordance with the present invention will now be discussed in detail. Referring initially to FIG. 1, it will be seen that the directions of rotation of the various drums and cylinders are as indicated by arrows. The first impression cylinder 6 is in the location, as shown in FIG. 1, in which a sheet 43 is being held at its front or leading edge 44 by means of the pivotable gripper systems 16 which is in the orientation depicted in FIG. 4. In this location, the rear or trailing edge 46 of this first sheet 43 has been taken over by the suction or vacuum gripper assembly 47 of the reversing drum 7. As was discussed previously, the pivoting movement of the gripper system 16 into the position shown in FIG. 4 is effected by the free rolling of the cam roller 33 over the frame fixed control cam 34 in the direction indicated by the arrow in FIG. 1. This pivotal movement of the gripper system 16 around the fulcrum 24 through the pivoting angle $\alpha$ of between 1° to 5° causes the leading edge 44 of the sheet 43 to move slightly rearwardly in opposition to the direction of rotation of the impression cylinder 6 due to the radius r. As the sheet gripper assembly 16 is moved radially outwardly and arcuately through the pivoting angle o, air under pressure is supplied from a suitable source and through suitable conduits and the like, all of which are not specifically shown, to the air supply line 29 and thence to the air duct 31 and the air blast jets 32. This air under pressure is blown through the air blast jets 32 generally in a direction which is tangential to the jacket 48 of the impression cylinder 6 and which is also between the sheet 43 and the surface of the impression cylinder 6. This will release the sheet 43 which will now assume the position shown in FIG. 2 in which the sheet 43 is effectively floating or swimming on the surface 48 of the first impression cylinder with its now leading edge 46 engaged by the suction grippers 47 of the reversing drum 7. A second sheet 49, which is also supported on the surface 48 of the first impression cylinder 6 is still partially in the impression position and is in contact with the plate cylinder 12 of the first printing unit 8. The gripper assembly 14 for this second sheet 49 is in the sheet gripping position which is shown in FIG. 5.

Figure 2:
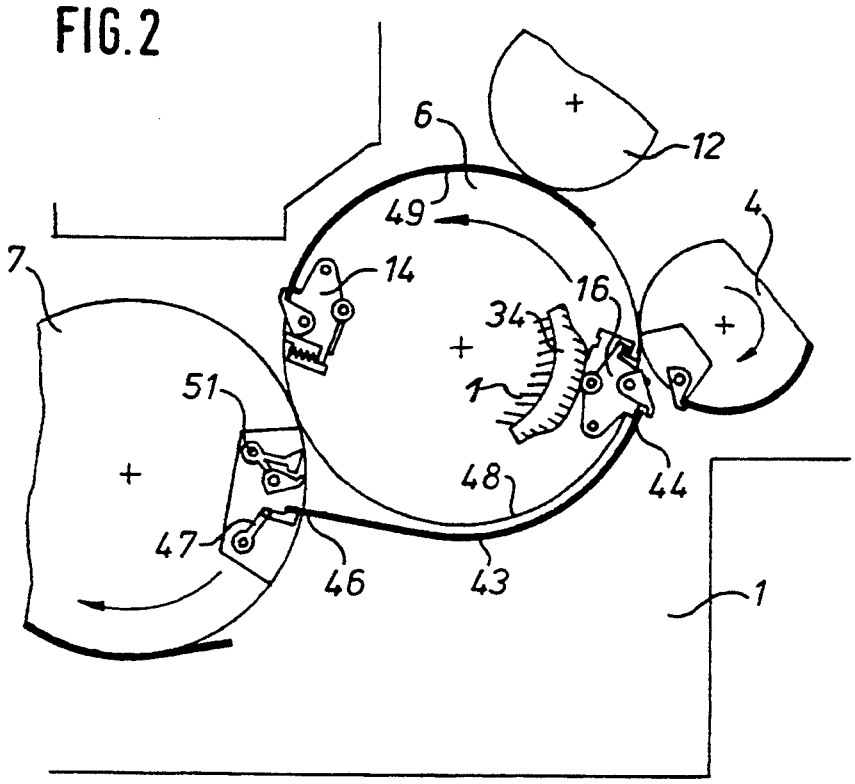
FIG. 2 is a schematic side view of a portion of the sheet reversing assembly of FIG. 1 and showing the assembly at a subsequent time.

As may be seen in detail in FIG. 2, once the impression cylinder has rotated slightly in the direction of the arrow with respect to its position as shown in FIG. 1, the gripper assembly 16 will be elevated as shown in FIG. 4, the air under pressure will be discharged through the air blast jets 32 in the abutment surface member 22 and the gripper elements will have released the edge 44 of the sheet 4 that they had been gripping. Since the sheet 43 is now under the control of the suction gripper 47 of the reversing drum 7, the end 44 of sheet 43 which has been released by the gripper assembly 16 is now the trailing end of the sheet. As can be seen in FIG. 2, the air under pressure emanating from the air blast jets 32 has now completely passed between the sheet 43 and the jacket or peripheral surface 48 of the first impression cylinder 6. The suction gripper assembly 47 can now transfer the now leading edge 46 of sheet 43 to the sheet grippers 51 on the reversing drum 7 for the purpose of transferring and reversing the sheet 43. A previously reversed third sheet 53 is shown in FIGS. 1–3 already on its way to the second impression cylinder 11.

Figure 3:
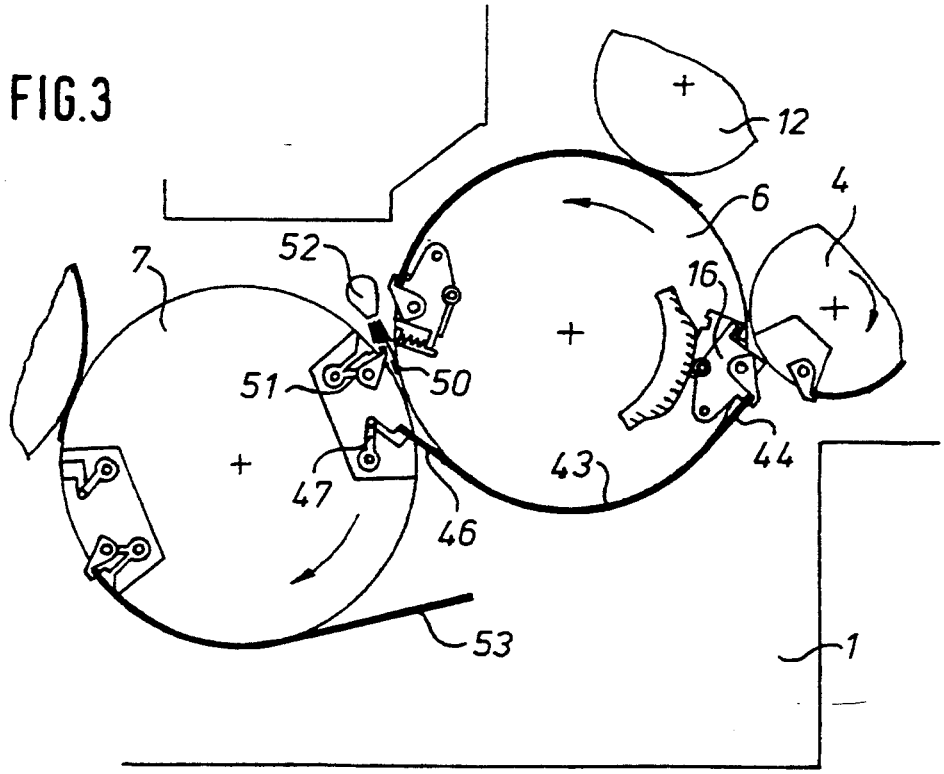
FIG. 3 is a view similar to FIG. 2 and showing an additional blast air jet arrangement.

As may be seen in FIG. 3, a fixed air blast device 52 may be secured to the machine frame between the first impression cylinder 6 and the reversing drum 7, as viewed in the sheet transport direction. This fixed air blast device 52 is located before the point of transfer of the sheet 43 from the first impression cylinder 6 to the reversing drum 7. This air blast device 52 directs a blast of air, as shown in FIG. 3, into a gap 50 between the sheet 43 and the jacket 48 of the first impression cylinder generally in the direction toward the front edge 44 of the sheet 43. The use of this fixed air blast device 52 is particularly beneficial in the reversal of thin and smooth sheets 43 as these sheets are more difficult to release from the peripheral surface of the impression cylinder 6. A thicker or less smooth sheet 43 is more easily released from the peripheral surface 48 of the first impression cylinder 6 by utilization of the pivotable sheet gripper assembly 16 and the associated air jet blast nozzles 32.

While a preferred embodiment of a sheet reversing assembly for a rotary printing press in accordance with the present invention has been set forth fully and completely hereinabove, it will be apparent to one of skill in the art that a number of changes in, for example the overall size of the impression cylinders, the specific type of plate and blanket cylinders, the number of printing units and the like could be made without departing from the true spirit and scope of the present invention which is accordingly to be limited only by the following claims.

What is claimed is:

1. A sheet reversing assembly in a rotary printing press, said sheet reversing assembly comprising:

a first impression cylinder;

at least a first sheet gripper assembly supported in a cylinder groove in said first impression cylinder, said first sheet gripper assembly including a gripper bar and a gripper abutment surface member;

means to support said first sheet gripper assembly in said cylinder groove for pivotal movement in said cylinder groove to selectively move said first sheet gripper assembly radially in said impression cylinder through a pivot angle about a pivot point;

a plurality of air escape openings in said gripper abutment surface member, said air escape openings being usable to direct air tangentially along said peripheral surface of said impression cylinder;

means to move said sheet gripper assembly through said pivot angle during rotation of said impression cylinder to elevate said air escape openings above said peripheral surface of said impression cylinder; and a sheet reversing drum positioned after, in a direction of sheet travel, said first impression cylinder, said sheet reversing drum having sheet grippers and receiving a sheet from said first impression cylinder.

2. The sheet reversing assembly of claim 1 further including an air blast device secured to a frame of the printing press, said air blast device extending axially parallel to said first impression cylinder and being usable to direct an air blast into a gap between said first impression cylinder and said sheet reversing drum.

3. The sheet reversing assembly of claim 1 wherein said means to support said sheet gripper assembly in said cylinder groove includes a support arm formed with said gripper abutment surface, said support arm being pivotably secured to said first impression cylinder and being pivotable about said pivot point.

4. The sheet reversing assembly of claim 3 wherein said gripper bar is supported in said cylinder groove by a cam roller and further wherein said cam roller rides on a control cam, said cam roller moving said sheet gripper assembly through said pivot angle.

5. The sheet reversing assembly of claim 4 further including a compression spring interposed between said gripper bar and a wall of said cylinder groove, said compression spring biasing said gripper bar radially inwardly in said cylinder groove.

6. The sheet reversing assembly of claim 3 wherein said support arm is movable through said pivot angle to move said gripper abutment surface member radially and circumferentially in said cylinder groove.

* * * * *